US005988260A

United States Patent [19]

Iwamoto et al.

[11] Patent Number: 5,988,260

[45] Date of Patent: Nov. 23, 1999

[54] METHOD FOR CONTROLLING INJECTION IN A DIE CASTING MACHINE AND APPARATUS FOR THE SAME

[75] Inventors: Norihiro Iwamoto, Sagamihara; Hiroshi Kitamura, Zama, both of Japan

[73] Assignee: Toshiba Kikai Kabushiki Kaisha, Tokyo, Japan

[21] Appl. No.: 08/812,310

[22] Filed: Mar. 5, 1997

[30] Foreign Application Priority Data

Mar. 5, 1996 [JP] Japan ..... 8-047519
Jun. 6, 1996 [JP] Japan ..... 8-144262

[51] Int. Cl.[6] ..... B22D 46/00; B22D 17/32

[52] U.S. Cl. ..... 164/457; 164/113; 164/312; 164/155.3; 164/155.4; 164/155.5; 164/154.1

[58] Field of Search ..... 164/457, 154.1, 164/155.3, 113, 312, 4.1, 155.4, 155.5

[56] References Cited

U.S. PATENT DOCUMENTS

| | | | |
|---|---|---|---|
| 4,334,575 | 6/1982 | Miki et al. | 164/113 |
| 5,067,550 | 11/1991 | Maekawa et al. | 164/120 |
| 5,119,866 | 6/1992 | Mihara | 164/120 |
| 5,363,899 | 11/1994 | Takagi et al. | 164/4.1 |
| 5,365,999 | 11/1994 | Stummer et al. | 164/457 |
| 5,622,217 | 4/1997 | Iwamoto et al. | 164/457 |
| 5,662,159 | 9/1997 | Iwamoto et al. | 164/457 |
| 5,671,797 | 9/1997 | Nozaki et al. | 164/457 |

FOREIGN PATENT DOCUMENTS

| | | | |
|---|---|---|---|
| 62-6754 | 1/1987 | Japan | 164/457 |
| 63-21121 | 1/1988 | Japan | 164/457 |
| 64-53754 | 3/1989 | Japan | 164/457 |
| 6-79432 | 3/1994 | Japan | 164/457 |

*Primary Examiner*—Harold Y. Pyon
*Assistant Examiner*—I.-H. Lin
*Attorney, Agent, or Firm*—Finnegan, Henderson, Farabow, Garrett & Dunner, L.L.P.

[57] ABSTRACT

A method for controlling injection in a die casting machine and apparatus for the same capable of producing high-quality die-casting products, which are not produced with fins, even in a high-speed cast or the use of the die with a low precision. A pressurizing controllable valve (21) is a flow adjustable type. A main spool (211) is structured to have a two-way valve (212) with a check-valve function and a position detector (213) for controlling servo, so that the flow of hydraulic fluid charged to a pressurizing cylinder device 20 is not controlled to be switched between ON-OFF but is allowed to adjustably flow, and a pressurizing process is controlled in response to a fin critical curve, thereby fins are previously avoided to be produced, thus producing the high-quality die-casting productions.

16 Claims, 12 Drawing Sheets

PRIOR ART

| POINT | 1 | 2 | 3 | 4 | 5 | 6 | 7 | 8 | 9 | 10 |
|---|---|---|---|---|---|---|---|---|---|---|
| SELECTION USING VELOCITY SETTING | USE | USE | USE | USE | USE | NON-USE | NON-USE | NON-USE | NON-USE | USE |
| POSITION mm | 50 | 220 | 250 | 370 | 410 | ----- | ----- | ----- | ----- | 416 |
| INJECTION VELOCITY m/s | 0.30 | 0.30 | 3.00 | 3.00 | 0.10 | ----- | ----- | ----- | ----- | 0.10 |
| SELECTION USING PRESSURE SETTING | USE | USE | USE | USE | USE | USE | USE | FEED AT EXTREMELY HIGH-SPEEDS | | PRESSURE START mm |
| TIME ms | 10 | 20 | 30 | 40 | 50 | 60 | 80 | STARTED PRESSURE | CHANGING POINT | |
| CASTING PRESSURE kgf/cm² (MPa) | 5 (0.5) | 20 (2.0) | 80 (7.8) | 200 (19.6) | 350 (34.3) | 599 (58.7) | 600 (58.8) | 2000 | 2 | 10 |

METHOD FOR CONTROLLING INJECTION IN A DIE CASTING MACHINE AND APPARATUS FOR THE SAME

BACKGROUND OF THE INVENTION

1. Field of the Invention

This invention relates to a method for controlling injection in a die casting machine and apparatus for controlling the same, more particularly, to an injecting control in a die casting machine capable of producing a high-quality die-casting product without fins.

2. Description of the Related Art

It is conventionally known that quality of a die-casting product is greatly influenced by an injection velocity or an injection pressure when molten material is fed into a die. Particularly, a sufficient pressurization is needed before the molten material is coagulated, therefore, a die casting machine having a two-stage driving cylinder device for injection and pressurization has been used.

Generally, in the aforementioned type die casting machine, after an injection plunger is advanced at low-speeds, the molten material is started feeding into a die cavity to avoid foaming the molten material and so on. The end of the molten material reaches a gate portion of the die, thereby the pressure of the injection cylinder device for feeding is increased. After that, the injection plunger is advanced at high-speeds to avoid decreasing the temperature of the molten material, and then the molten resin is rapidly fed into the die cavity.

Following an injection process as described above, at the time the pressure of the injection cylinder device is further increased by filling the die with the molten material or at the time the injection plunger is advanced to a predetermined position corresponding to completion of feeding, a high-pressure is added to the injection cylinder device by a pressurizing cylinder device to operate a pressurizing process for increasing the pressurization to the molten material fed into the die by the injection plunger.

(Concrete explanation of the conventional die casting machine of a pressurizing system)

The conventional die casting machine of the two-stage cylinder pressurizing system will be explained in detail below.

In the die casting machine 90 shown in FIG. 7, a molten material 92 fed into the die cavity 91 is charged into an injection sleeve 93, and injected by driving an injection plunger 94 by using an injection cylinder device 95 for feeding. And further, hydraulic fluid charged in a back side of the injection cylinder device 95 is charged with pressure at the high-pressure by using a pressurizing cylinder device 96 having a larger diameter after the feeding of molten material 92 is completed, the molten material 92 fed into the die cavity 91 is pressurized through the injection cylinder device 95.

FIG. 8 shows injection velocity change CV and injection pressure change CP in an injecting process to a pressurizing process in the die casting machine 90. In the drawing, the injection cylinder device 95 is advanced at a low-velocity VL at the outset, and, begins advanced at high-velocity VH at time t1 to feed the molten material 92 in a stroke, after that it is braked by receiving a feeding pressure of the molten material as feeding finishes. At time t2, the pressurizing cylinder 96 is driven to pressurize the molten material, thereby a pressure of the molten material 92 fed into the die cavity 91 reaches a pressure PH, and then the injection cylinder 95 is further advanced and stopped at time t3. This stopping point is a stroke end of the injection cylinder device 95.

For a linking control between the injection cylinder device 95 and the pressurizing cylinder device 96 in the die casting machine 90 (changing from the injecting process to the pressurizing process) as described above, a sequence valve system, in which the change is carried out with detection of an injection-pressure fluctuation, or a limit switch system, in which the change is carried out with detection of an advanced position of the injection plunger, is employed.

(Oil hydraulic circuit in the sequence valve system)

The following oil hydraulic circuit is used in the sequence valve system.

As shown in FIG. 9, the injection cylinder device 95 is connected with an injection oil hydraulic circuit 114 leading through a check valve 111 and an injection velocity adjusting valve 112 to an accumulator 113. The pressurizing cylinder device 96 is connected with a pressurizing oil hydraulic circuit 117 leading through a pressurizing controlling valve 116 of a pilot operation, opened by a sequence valve 115, to the accumulator 113.

The sequence valve 115 is defined to open the pressurizing controlling valve 116 when the pressure of the injection oil hydraulic circuit 114 exceeds a predetermined pressurizing-start pressure. Therefore, the injection cylinder device 95 is started advancing to inject by operating the injection velocity adjusting valve 112, and the feeding pressure is increased with the complete feed of the molten material into the die and reaches the predetermined pressurizing-start pressure, whereupon the sequence valve 115 is driven to open the pressurizing controlling valve 116, and then the pressurization is performed by starting advancing the pressurizing cylinder device 96.

FIG. 10 concretely shows a surrounding area of the injection cylinder device 95 and the pressurizing cylinder device 96.

The injection cylinder device 95 has an injection piston 95A therein, in which the injection piston 95A is advanced by an oil pressure of hydraulic fluid charged from the injection oil hydraulic circuit 114 to the back side of the injection piston 95A. The hydraulic fluid charged from the injection oil hydraulic circuit 114 flows to be adjusted by injection velocity adjusting valve 112, whereby the injection piston 95A is switched between advance and stop and an advancing velocity is adjusted.

The pressurizing cylinder device 96 has a pressurization piston 96A therein, in which the pressurization piston 96A is advanced by an oil pressure of hydraulic fluid charged from the pressurizing oil hydraulic circuit 117 to the back side of the pressurization piston 96A, thereby the injection piston 95A is pressed from the back side thereof through an intermediate member 95B of the injection cylinder device 95. The hydraulic fluid charged from the pressurizing oil hydraulic circuit 117 is intermittently controlled by the pressurizing controllable valve 116, whereby the pressurizing piston 96A is switched between advance and stop.

Intermittence of the pressurizing controllable valve 116 is carried out by the sequence valve 115. As the sequence valve 115, a solenoid valve, changing based on the feeding pressure by appropriate means, or the like is used.

Incidentally, in the conventional two-stage die casting machine as described above, the flow of the hydraulic fluid charged to the pressurizing cylinder device is fixed without an adjustable control in the pressurizing process in which the injection cylinder device is pressurized with the pressurizing cylinder device. Because, the hydraulic fluid charged to the pressurizing cylinder device is intermitted in the pressurizing controllable valve, in which a constant flow valve of an ON-OFF two-point switching type is conventionally used as the pressurizing controllable valve.

The hydraulic fluid is charged to the pressurizing cylinder device at a constant flow, so that a pressurizing properties of a casting pressure is to be the injection pressure change CP as shown in FIG. 8, in which the upturned curve makes a quadratic curve becoming gradually gentle slope as approaching the highest pressure PH. This is why the injection plunger receives resistance as the molten material in the die is being coagulated, so that the pressurization becomes slow. Concretely, the casting pressure P is proportional to the square root of the product of an elapsed time t and a coefficient a.

On the other hand, a fin critical pressurizing curve is known in the pressurizing process. The molten material leaks from a parting line of the dies when the exceeding pressure is added to the die in the pressurization, with the result that fins are produced. But, fins are not produced when the pressure is less than the fin critical pressurizing curve. The fin critical curve is given as a curve CX in which the casting pressure P is proportional to the product of the coefficient a and the square of the elapsed time t (see FIG. 8).

The reason why the fin critical curve CX is to be the quadratic curve as described above is because the molten material in the die, which does not coagulate in the early stage of the pressurization, easily leaks from the parting line in view of the high flow characteristics of the molten material, so that the high pressure cannot be added, but the molten material hardly leaks from the parting line after beginning to coagulate with the passage of time, so that fins are not produced although the high pressure is added.

In the aforementioned conventional die casting machine, however, the hydraulic fluid is charged to the pressurizing cylinder device in the constant flow, therefore, the pressurizing properties of the casting pressure is not allowed to approach the fin critical curve. As a result, the conventional die casting machine is presented with a disadvantage that the good quality die-casting products cannot be produced in view of substantially produced fins in the high-speed cast or the use of the die having the parting line with a low precision.

It is an object of the present invention to provide the method for injecting in the die casting machine and the apparatus for the same capable of producing the high-quality die-casting products, which are not produced with fins, even in a high-speed cast or the use of the die with a low precision.

SUMMARY OF THE INVENTION (Method according to the present invention)

A method for controlling injection in a pressurizing-type die casting machine according to the present invention, which has an injection plunger injecting molten material into a casting die, an injection cylinder device driving the injection plunger, and a pressurizing cylinder device pressurizing oil pressure added to the injection cylinder device, is characterized by the steps of: controlling the flow of hydraulic fluid flown to the pressurizing cylinder device during a pressurizing process caused by the pressurizing cylinder device; and controlling the pressurizing process to change the relationship between a casting pressure and a pressurizing period based on a selective curve along a predetermined critical curve which does not allow the casting die to produce fins.

According to the above method, in the pressurizing process, the flow of the hydraulic fluid charged to the pressurized cylinder device is not controlled to be switched between ON-OFF but is allowed to adjustably flow, and fins are previously avoided to be produced in view of the control of the pressurizing process in response to the fin critical curve, thus producing the high-quality die-casting products.

In the method of the present invention, it is advisable that the oil pressure of the hydraulic fluid, flown to the pressurizing cylinder device, is controlled to correspond with the ultimate pressure of the casting pressure in the casting die before controlling the flow of the hydraulic fluid flown to the pressurizing cylinder device.

According to the above method, the ultimate pressure in the pressurizing process caused by the pressurizing cylinder device is appropriately adjusted, resulting in a contribution toward producing the high-quality die-casting products without fins.

In the method of the present invention, it is advisable that the hydraulic fluid is controlled to be charged to and discharged from the injection cylinder device from a starting position of the injection plunger to a predetermined position before a stroke end so that a positional feedback control of the injection plunger is carried out; and the pressurizing process is controlled to change the relationship between the casting pressure and the pressurizing period based on the selective curve along the predetermined critical curve, which does not allow the die casting die to produce fins, after the injection plunger reaches the predetermined position.

Thereby allowing the injection process caused by the injection cylinder device and the pressurizing process caused by the pressurizing cylinder device to be smoothly linked.

In the present invention, it is desirable that the control of the flow of the hydraulic fluid flown to the pressurizing cylinder device is a flow control to cause the casting pressure to increase to the $n^{th}$ degree as shown in the following equation;

$$P=a(t)^n,$$

where P is the casting pressure, a is a coefficient, t is time and n is a coefficient within the range of $0<n<3$.

The above definition is suitable to prevent from producing fins and to produce the high-quality die-casting products in view of approximations to the fin critical curve.

In the present invention, it is advisable to use a flow controlling valve having a check-valve function and a main spool controlling the flow of the hydraulic fluid flown to the pressurizing cylinder device, a position detector detecting the degree of opening the main spool of the flow controlling valve, and a pressurizing controlling device controlling the main spool of the flow controlling valve based on a predetermined program; to control the selective degree of opening the main spool between the full opening and the final opening during the pressurizing process caused by pressurizing cylinder device; and control the pressurizing process to change the relationship between the casting pressure and the pressurizing period based on the selective curve along the predetermined critical curve which does not allow the die casting to produce fins.

According to the above method, with the use of the main spool, the flow control for the pressurizing cylinder device is carried out by controlling the degree of opening the main spool, resulting in the smooth flow control.

In the method of the present invention, it is advisable to include the steps of starting the injection process to advance the injection plunger by using the injection cylinder device; controlling to charge and discharge the hydraulic fluid to and from the injection cylinder device so that the velocity and advancing position of the injection plunger are feedback-controlled; decelerating the injection cylinder device when the injection cylinder device reaches a decelerating-start position at a predetermined distance before the stroke end; starting the pressurizing process caused by the pressurizing cylinder device when the injection cylinder device reaches a predetermined pressurizing-start position placed in the vicinity of the stroke end rather than the decelerating-start position; and performing pressurizing control by controlling the opening of the main spool.

According to the above method, the advancing state of the injection cylinder device is adjustably controlled with the feedback system even in the injection process, thus having good effect on produce of the high-quality die-casting products.

In the present invention, it is advisable to comprise the steps of starting the injection process to advance the injection plunger by using the injection cylinder device; controlling a back pressure of the injection cylinder device with a back pressure controllable valve, using a fast-response electric-hydraulic servo two-way valve, located on a hydraulic fluid discharge channel of the injection cylinder device so that an advancing position and velocity of the injection plunger is feedback-controlled; decelerating the injection cylinder device when the injection cylinder device reaches a decelerating-start position at a predetermined distance before the stroke end; releasing the back pressure of the injection cylinder device by fully opening the back pressure controllable valve when the injection cylinder device reaches a back pressure release position placed in the vicinity of the stroke end rather than the decelerating-start position; starting the pressurizing process caused by the pressurizing cylinder device when the injection cylinder device reaches the pressurizing-start position adjacent to the back pressure release position; and performing pressurizing control by controlling the opening of the main spool.

According to the above method, the advancing state of the injection cylinder device is adjustably controlled by using the back pressure even in the injection process, and further, when the process is moved to the pressurizing process, the pressurization is allowed to be effectively used by releasing the back pressure control of the injection cylinder device, thus having good effect on produce of the high-quality die-casting products.

(Apparatus according to the present invention)

An injection controlling apparatus of a pressurizing-type die casting machine according to the present invention, which has an injection plunger injecting molten material into a casting die, an injection cylinder device driving the injection plunger, and a pressurizing cylinder device pressurizing oil pressure added to the injection cylinder device, is characterized by including an injection controlling means for performing a positional feedback control of the injection plunger by controlling to charge and discharge hydraulic fluid to and from the injection cylinder device; a flow controlling means for controlling the flow of the hydraulic fluid for the pressurizing cylinder device; and a pressurizing controlling device means for controlling a pressurizing process to change the relationship between a casting pressure and a pressurizing period based on a selective curve along a predetermined critical curve which does not allow the casting die to produced fins by controlling the flow controlling means during the pressurizing process caused by the pressurizing cylinder device.

According to the above structure, the aforementioned adjustable control for charging the hydraulic fluid in the pressurizing process is achieved and the device capable of achieving the adjustable control in the injection process before the pressurizing process is obtained, thus producing the high-quality die-casting products.

In the apparatus of the present invention, it is advisable to have a casting pressure adjustment means for controlling the oil pressure of the hydraulic fluid, charged to the pressurizing cylinder device, to correspond with the ultimate pressure of the casting pressure.

By the above structure, the ultimate pressure of the pressurizing process caused by the pressurizing cylinder device is appropriately adjusted, resulting in a contribution toward producing the high-quality die-casting products without fins.

In the apparatus of the present invention, it is advisable that the pressurizing controlling means controls the pressurizing process to control the flow controlling means based on a predetermined program.

Therefore, the aforementioned flow control in the pressurizing process is easily achieved.

In the apparatus of the present invention, it is advisable that the pressurizing controlling means controls the flow controlling means so that the casting pressure is to be a controlling pressure target value defined at each predetermined interval in the passage of time commencing from the start of the pressurizing process.

According to the above structure, the aforementioned flow control in the pressurizing process is easily achieved and the control is appropriately performed.

In the apparatus of the present invention, it is advisable that wherein the injection controlling means carries out a positional feedback control for the injection plunger to control the back pressure of the side, discharging the hydraulic fluid, of the injection cylinder device.

Therefore, the control of the injection process before the pressurizing process is easily achieved.

In the apparatus of the present invention, it is advisable that the flow controlling means has a flow controlling valve, having a check-valve function and a main spool controlling the flow of the hydraulic fluid flown to the pressurizing cylinder device, and a position detector detecting the degree of opening the main spool of the flow controlling valve; and the pressurizing controlling means controls the degree of opening the main spool to be selected between the full opening and the final opening during the pressurizing process caused by the pressurizing cylinder device in order to control the pressurizing process to change the relationship between the casting pressure and the pressurizing period based on the selective curve along the predetermined critical curve which does not allow the casting die to produce fins.

According to the above structure, with the use of the main spool, the flow control for the pressurizing cylinder device is performed by the controlling the degree of opening the main spool, thereby allowing the flow control to be smoothly carried out.

In the apparatus of the present invention, it is advisable to have an injection controlling means for performing a positional feedback control of the injection plunger to control the back pressure of the side, discharging the hydraulic fluid, of the injection cylinder device; a casting pressure adjustment means for controlling the oil pressure of the hydraulic fluid, flown to the pressurizing cylinder device, to correspond with the ultimate pressure of the casting pressure previously defined; a flow controlling valve having a check-valve function and a main spool controlling the flow of the hydraulic fluid flown to the pressurizing cylinder device and controlled by the casting pressure adjustment means; a position detector detecting the degree of opening the main spool of the flow controlling valve; and a pressurizing controlling device controlling the degree of opening the main spool to be selected between the full opening and the final opening based on a predetermined program during the pressurizing process, caused by the pressurizing cylinder device, in order to control the pressurizing process to change the relationship between a casting pressure and a pressurizing period based on a selective curve along a predetermined critical curve which does not allow the casting die to produce fins.

According to the above structure, the apparatus capable of adjusting the aforementioned charge of the hydraulic fluid in the pressurizing process and linking with the back pressure control in the injection process is obtained, thus producing the high-quality die-casting products.

In the apparatus of the present invention, it is advisable that the pressurizing controlling means controls the degree of opening the main spool so that the casting pressure is to be a controlling pressure target value defined at each predetermined interval in the passage of time commencing from the start of the pressurizing process.

According to the above structure, the flow of the hydraulic fluid in the pressurizing process is easily, certainly and properly controlled every predetermined elapsed time, thus having good effect on the achievement of the pressurizing control of the aforementioned flow adjustable type.

DETAILED DESCRIPTION OF THE PREFERRED EMBODIMENT(S)

The first embodiment according to the present invention will be explained below with reference to the attached drawings.

First Embodiment

The embodiment is performed by improving an existing die casting machine, in which a die, an injection plunger, and so on used as basic parts of the existing die casting machine are appropriately available (e.g., the structure of the aforementioned die casting machine 90), so that the description is omitted. The following is explanations as to an injection cylinder device, a pressurizing cylinder device and an oil hydraulic circuit for charging hydraulic fluid to both of the devices which are different from such existing devices and oil hydraulic circuit.

Figure 1:
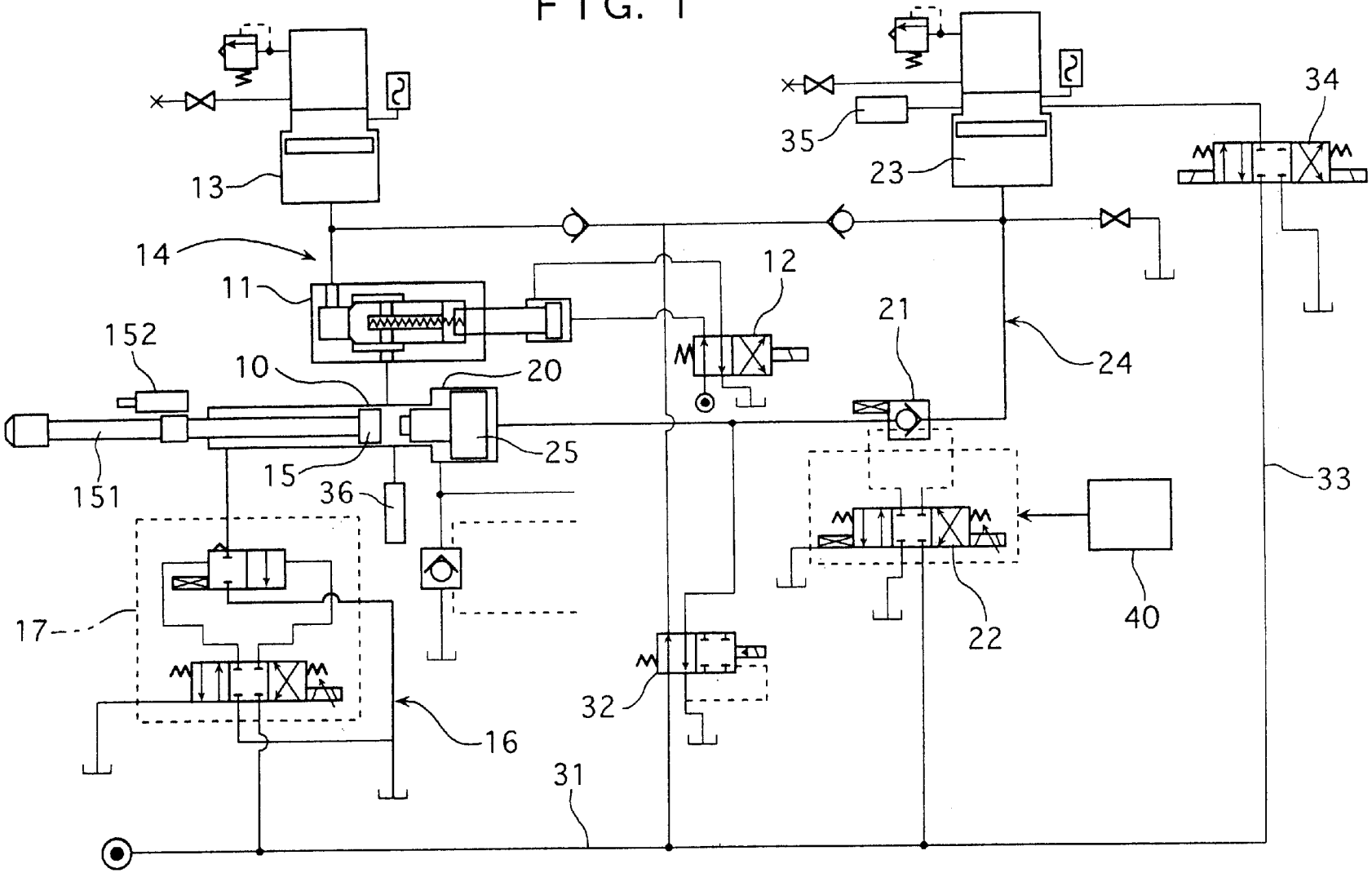
FIG. 1 is a circuit diagram showing the first embodiment according to the present invention.

In FIG. 1, an injection cylinder device 10 is connected to an injection oil hydraulic circuit 14 leading through a pilot check valve 11 for intermitting an injection process to an injection accumulator 13. The check valve 11 is controlled to be opened by a solenoid change-over valve 12 for opening, in which the check valve 11 is opened by operating the change-over valve 12 to charge the hydraulic fluid, flown from the injection accumulator 13, to the injection cylinder device 10, and then an injection piston 15 is advanced.

The check valve 11 moves a valve member with a spring provided therein when the hydraulic fluid stops flowing from the injection accumulator 13 to the injection cylinder device 10 and the different pressure between an inlet port and an outlet port is disappeared, thereby the hydraulic fluid is prevented from back-flowing in the pressurizing process. The injection cylinder device 10 is connected with a hydraulic fluid discharging channel 16, discharging the hydraulic fluid flown in the head area of the injection piston 15, which is connected to a flow controllable valve 17 for controlling the injection velocity.

The flow controllable valve 17 for controlling the injection velocity is composed of a fast-response type high-flow servo valve, in which the injection cylinder device 10 is advanced, the hydraulic fluid discharging channel 16 is throttled by adjusting the opening thereof, thereby the back pressure is added to the injection piston 15 to adjust the advancing velocity.

A pressurizing cylinder device 20 is connected to a pressurizing oil hydraulic circuit 24 leading through a pressurizing controllable valve 21 for controlling a pressurizing period, which the opening of the valve 21 is controlled by a pilot servo valve 22, to a pressurizing accumulator 23, in which the pressurizing controllable valve 21 is opened by operating the pilot servo valve 22 to charge the hydraulic fluid, flown from the pressurizing accumulator 23, to the pressurizing cylinder device 20, and then a pressurizing piston 25 is advanced.

Figure 2:
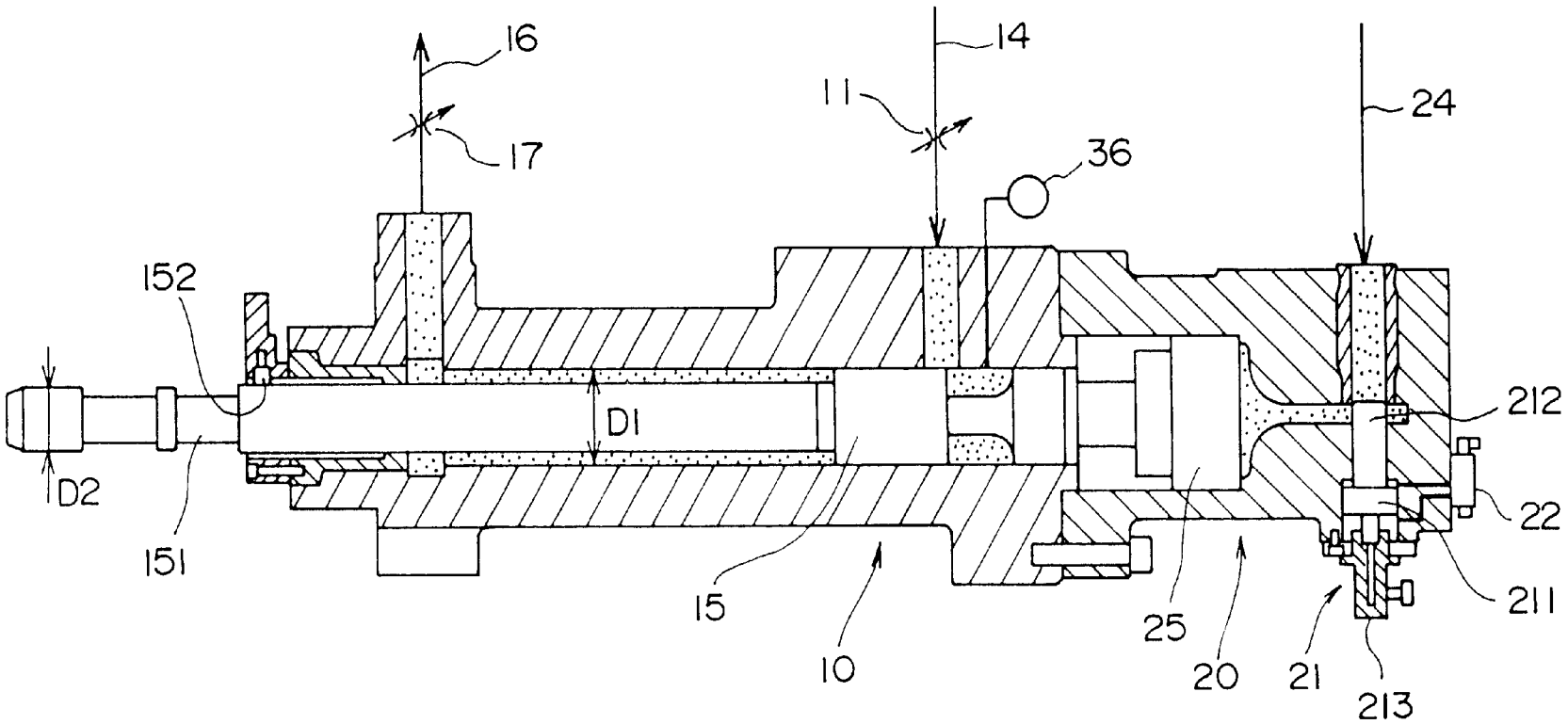
FIG. 2 is a sectional view showing a cylinder device of the first embodiment.
Figure 3:
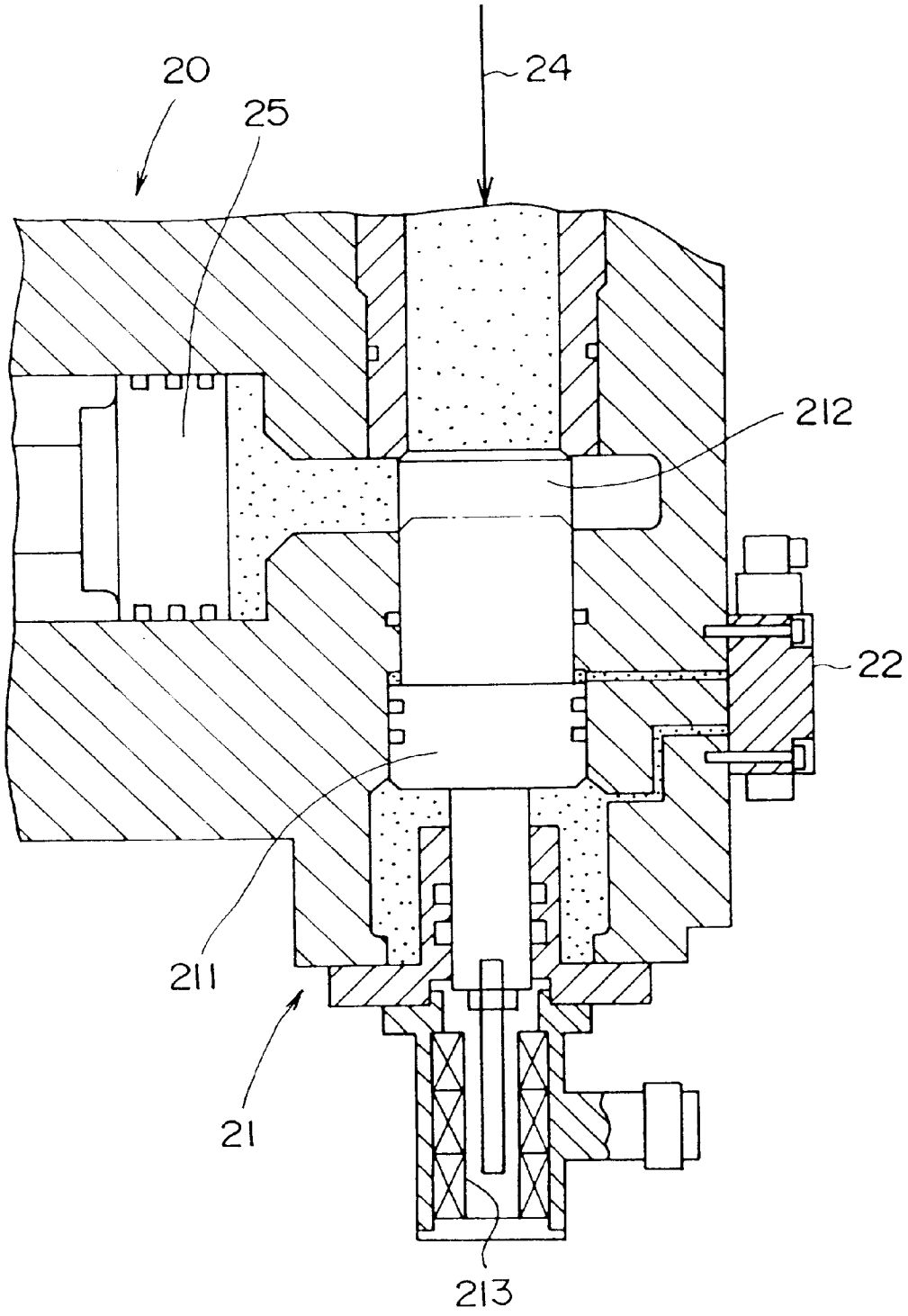
FIG. 3 is a fragmentary enlarged sectional view of the cylinder device of the first embodiment.

As shown in FIG. 2, the pressurizing controllable valve 21 structures an electric-oil pressure two-stage servo valve, having the fast-response type pilot servo valve 22 as an auxiliary servo valve and a main spool 211 as a main servo valve.

A flow controlling two-way valve 212 with a check-valve function is formed at one end portion of the main spool 211, and a position detector 213 is provided at the other end portion. The pilot servo valve 22 is controlled by getting feedback of the opening position from the position detector 213, thereby the pressurizing controllable valve 21 is allowed to selectively adjust the opening.

Therefore, the pressurizing controllable valve 21 has a function as the flow controllable valve in addition to functions as the check valve and the two-way valve.

More specifically, when the pressurizing controllable valve 21 is closed by operating the pilot servo valve 22 in the injection operation before the pressurizing operation, the hydraulic fluid flown from the pressurizing accumulator 23 is not charged to the pressurizing cylinder device 20, and further the back-flow from the pressurizing cylinder device 20 is avoided.

And, in the pressurizing process, the pressurizing controllable valve 21 is opened by operating the pilot servo valve 22, and the opening position of the main spool 212 is selectively adjusted, thereby the hydraulic fluid flown from the pressurizing accumulator 23 is charged to the pressurizing cylinder device 20, and the flow of the hydraulic fluid flown to the pressurizing cylinder device 20 is selectively adjusted.

Turning to FIG. 1, each of the injection accumulator 13 and the pressurizing accumulator 23 is connected to a hydraulic fluid charging channel 31, led from a hydraulic source, so as to be charged the high-pressure hydraulic fluid. At some midpoint in the hydraulic fluid charging channel 31, a solenoid accumulator charge change-over valve 32 is provided to intermittingly charge the hydraulic fluid to each of the accumulators 13 and 23.

The pressurizing accumulator 23 is connected at the back side thereof to a branching channel 33 from the hydraulic fluid charging channel 31, in which a solenoid casting pressure controllable valve 34 is provided on some midpoint of the branching channel 33.

The casting pressure controllable valve 34 sends the hydraulic fluid, flown from the hydraulic source, to cause the back pressure of the pressurizing accumulator 23 to increase, so that the maximum oil pressure of the pressurizing oil hydraulic circuit 24 is increased, thereby allowing the maximum casting pressure added to the pressurizing cylinder device 20 to be increased. Inversely, when the casting pressure controllable valve 34 allows the hydraulic fluid to escape to cause the back pressure of the pressurizing accumulator 23 to decrease, the maximum oil pressure of the pressurizing oil hydraulic circuit 24 is decreased, thereby allowing the maximum casting pressure added to the pressurizing cylinder device 20 to be decreased.

The pressurizing accumulator 23 is provided with a pressure sensor 35 sensing the pressure of the back side thereof, in which the back flowing value of the pressurizing accumulator 23 can be referred in the aforementioned adjustment of the casting pressure.

The injection cylinder device 10 is provided with a pressure sensor 36 sensing the casting pressure, in which the injection pressure value can be directly referred in the aforementioned adjustment of the casting pressure. As a matter of fact, the injection pressure PR results from multiplying a detected pressure PS and the square of (D1/D2) together in response to the proportion of a diameter D1 of the injection piston 15 to a diameter D2 of an injection plunger 151.

The injection cylinder device 10 is provided with an encoder 152 detecting the advanced position of the injection plunger 151, in which a stroke position is directly detected in the injection process.

In order to receive signal sent from each of the sensors and control each operation of the valves, a control system 40 is provided. The prime constituents of the control system 40 are an existing computer system, a programmable controller and so on, in which the valves are operated with the predetermined procedures based on a previously defined process program so as to carry out the injection process and the pressurizing process.

The control system 40 includes a control circuit in order to cause the pressurizing cylinder device 20 to carry out the pressurizing process by controlling the pressurizing controllable valve 21.

Figure 4:
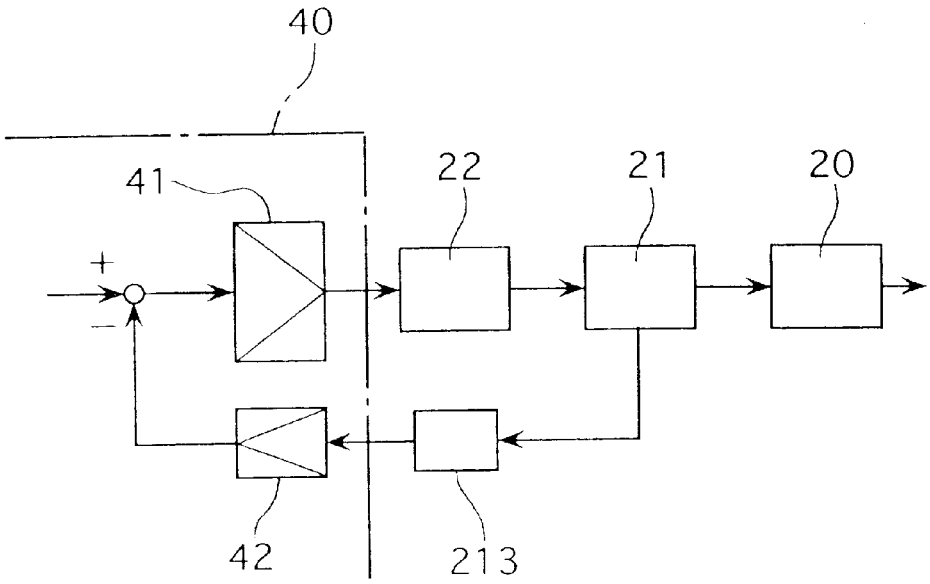
FIG. 4 is a block diagram showing a control system of the first embodiment.

In FIG. 4, the control system 40 has a servo amplifier 41, in which an opening instruction is sent through the servo amplifier 41 to the pressurizing controllable valve 21 when the pressurizing process is carried out based on the previously defined program. The pressurized controllable valve 21 is opened, whereupon the pressurizing cylinder device 20 is operated in response to the degree of opening the valve 21, and the degree of opening the pressurizing controllable valve 21 (the opening position of the main spool 211) in the above state is detected by the position detector 213 and returned through a positional feedback amplifier 42 to the control system 40. As a result, the pressurizing controllable valve 21 undergoes the feedback control and the pressurizing properties of the pressurizing process can be controlled in detail.

Figure 5:
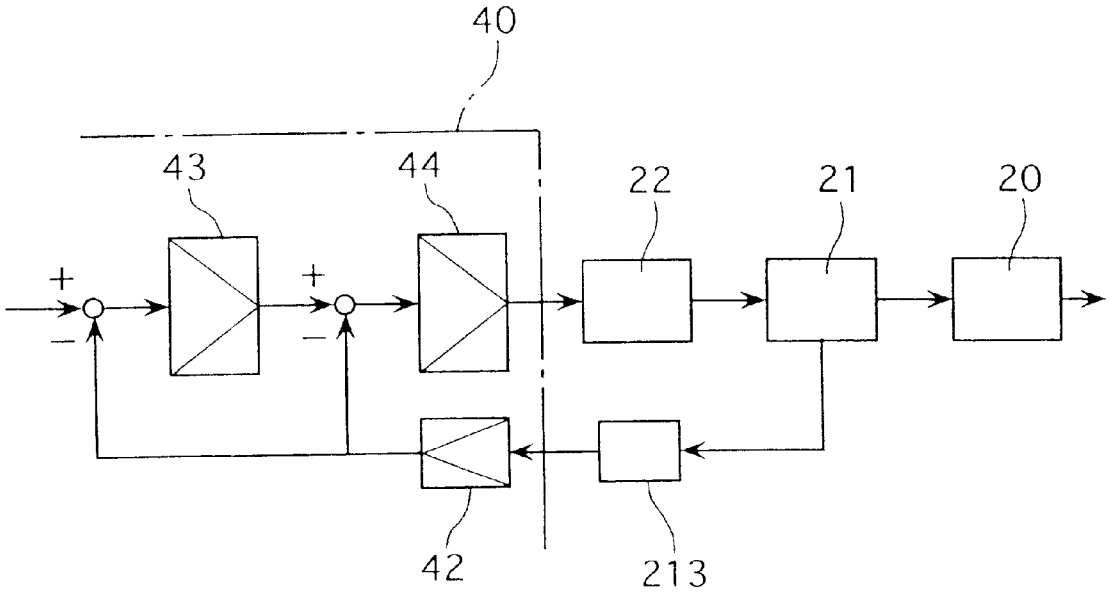
FIG. 5 is a block diagram showing another control system of the first embodiment.

FIG. 5 shows another example of the feedback control system of the pressurizing controllable valve 21. In the drawing, instruction based on the previously defined program is sent through a preamplifier 43 and a main-amplifier 44 to the pressurizing controllable valve 21. It is similar to the control system of the FIG. 4 described above that the pressurizing controllable valve 21 is opened, whereupon the pressurizing cylinder device 20 is operated based on the degree of opening the valve 21, and the degree of opening the pressurizing controllable valve 21 in this state is detected by the position detector 213, but, here, a part of the opening signal from the position detector 213 is returned through the positional feedback amplifier 42 to the main-amplifier 44 as a minor feedback signal, and the other part of the signal is returned through the positional feedback amplifier 42 to the preamplifier 43 as the positional feedback signal. Thus improving stability and precision of the servo control system.

In the structure described thus far, the control system 40 controls each of the parts based on the predetermined program to carry out the desired injection process and pressurizing process.

That is to say, after the molten material is charged into the injection sleeve to prepare for injecting to the die, the check valve 11 is opened to charge the hydraulic fluid, flown from the injection accumulator 13, to the injection cylinder device 10, and then the injection plunger 151 is advanced.

At this time, the flow controllable valve 17 for controlling the injection velocity is throttled and the injection velocity is low.

When the injection plunger 151 is advanced to a position where the molten material reaches the die gate, the flow controllable valve 17 for controlling the injection velocity is opened to change the injection velocity to high-velocity, thereby the molten material is fed into the die in a stroke.

And, when the injection plunger 151 is advanced to a position where the molten material is filled in the die, the injection process is stopped by closing the check valve 11, and for the pressurizing process, the flow controllable valve 17 for controlling the injection velocity is opened to completely release brake of the back pressure of the injection plunger 151.

Here, the pilot servo valve 22 is operated to open the pressurizing controllable valve 21 at the predetermined degree of the opening, so that the hydraulic fluid flown from the pressurizing accumulator 23 is charged to the pressurizing cylinder device 20, thereby the pressurization from the back side of the injection piston 15 to the injection plunger 151 is carried out.

At this time, the opening of the pressurizing controllable valve 21 is throttled and the degree of the opening is changed during this process, thereby a period of time for reaching the maximum pressure and the pressure during the pressurizing process is controlled to create a similar pressurizing curve as the fin critical curve previously defined based on measurement or the like.

Figure 6:
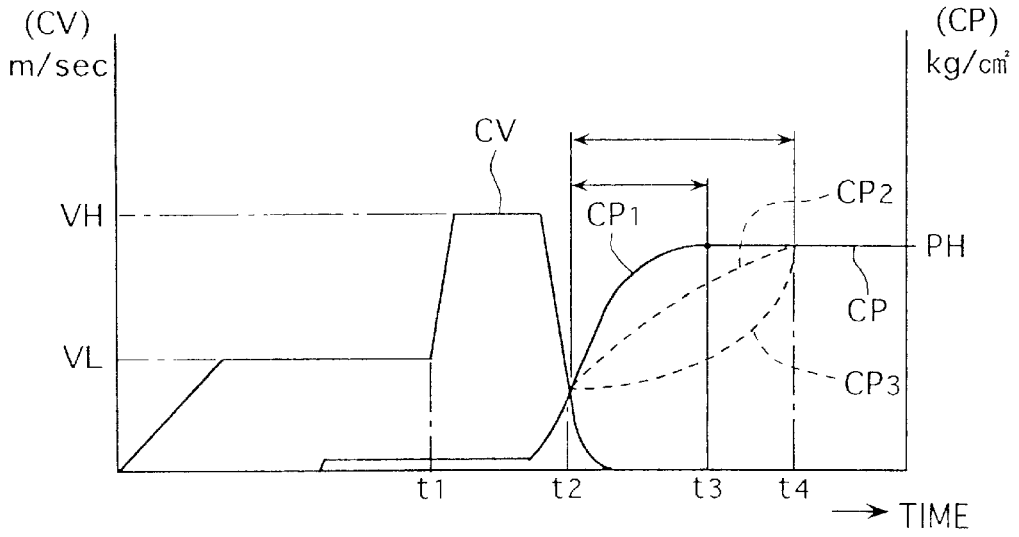
FIG. 6 is a graph showing an injection process and a pressurizing process according to the first embodiment.
Figure 7:
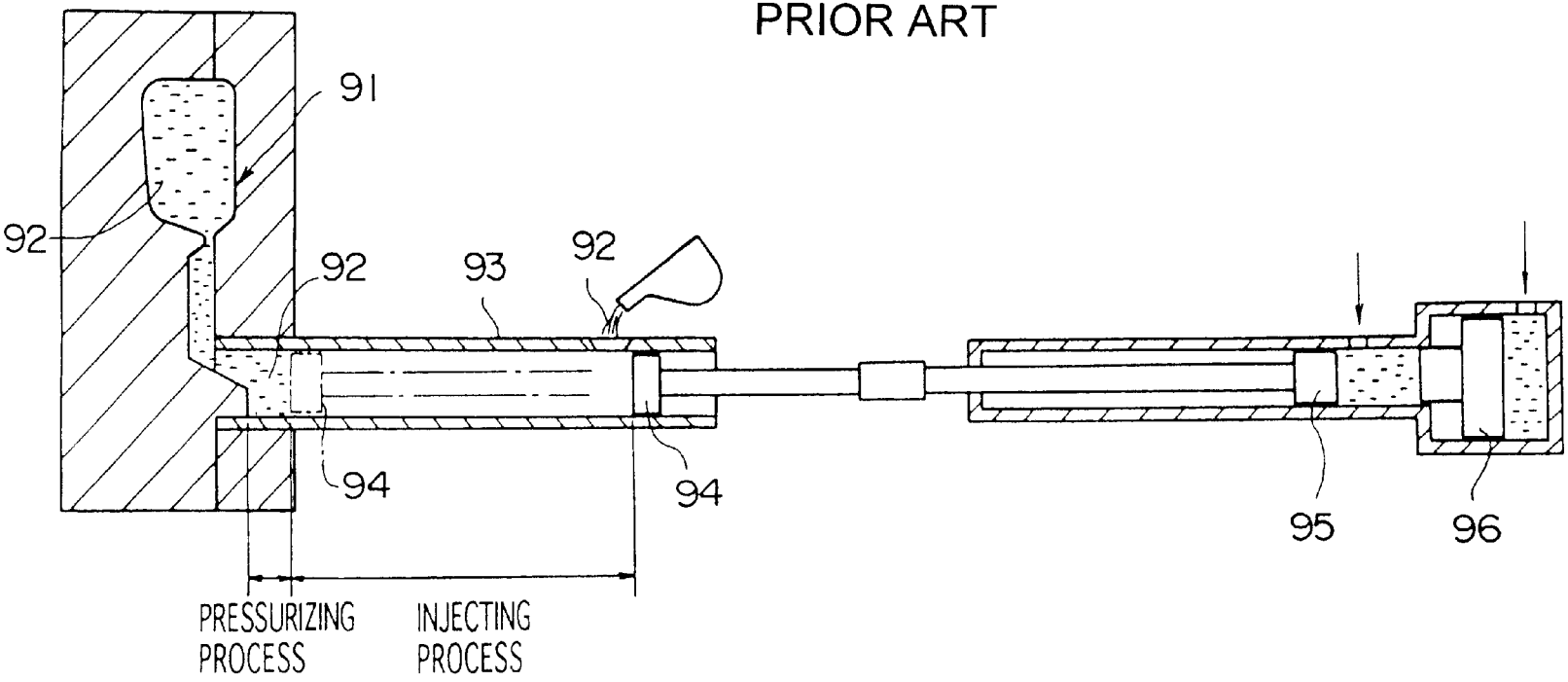
FIG. 7 PRIOR ART
FIG. 7 is a sectional view showing a cardinal structure of a conventional die casting machine.

In the FIG. 6, a pressurizing curve CP1 is a gradually gentle pressurizing curve also obtained in the existing die casting machine.

But, by throttling the opening of the pressurizing controllable valve 21, the slope of increasing the pressure is gentle like a pressurizing curve CP2, and further the period of reaching the maximum pressure PH is longer.

By further throttling the opening of the pressurizing controllable valve 21, the increase of the pressure is rapid in the later half like a pressurizing curve CP3 and reaches the maximum pressure P4 at time t4.

Figure 8:
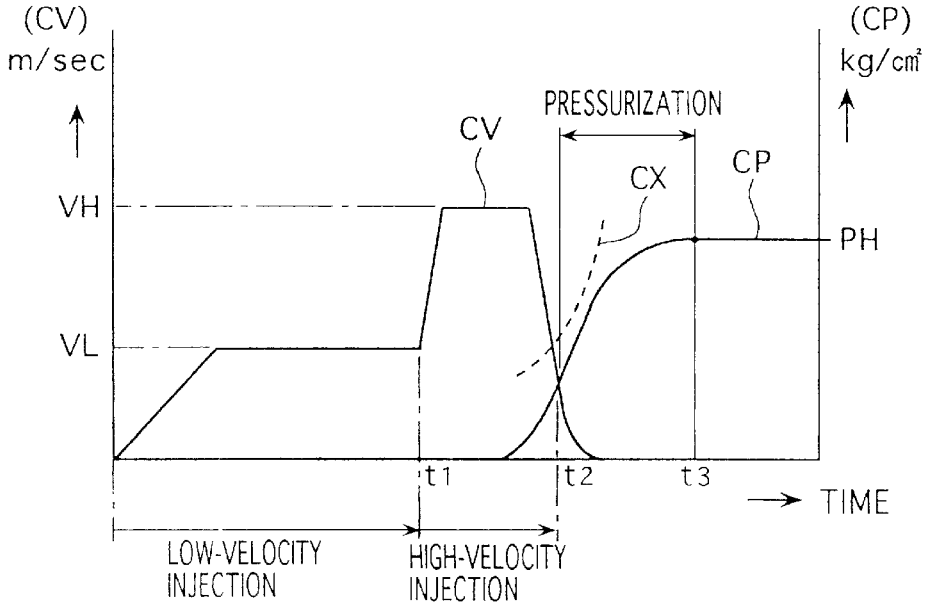
F I G. 8 PRIOR ART
FIG. 8 is a graph showing the injection process and the pressurizing process in the conventional die casting machine.
Figure 9:
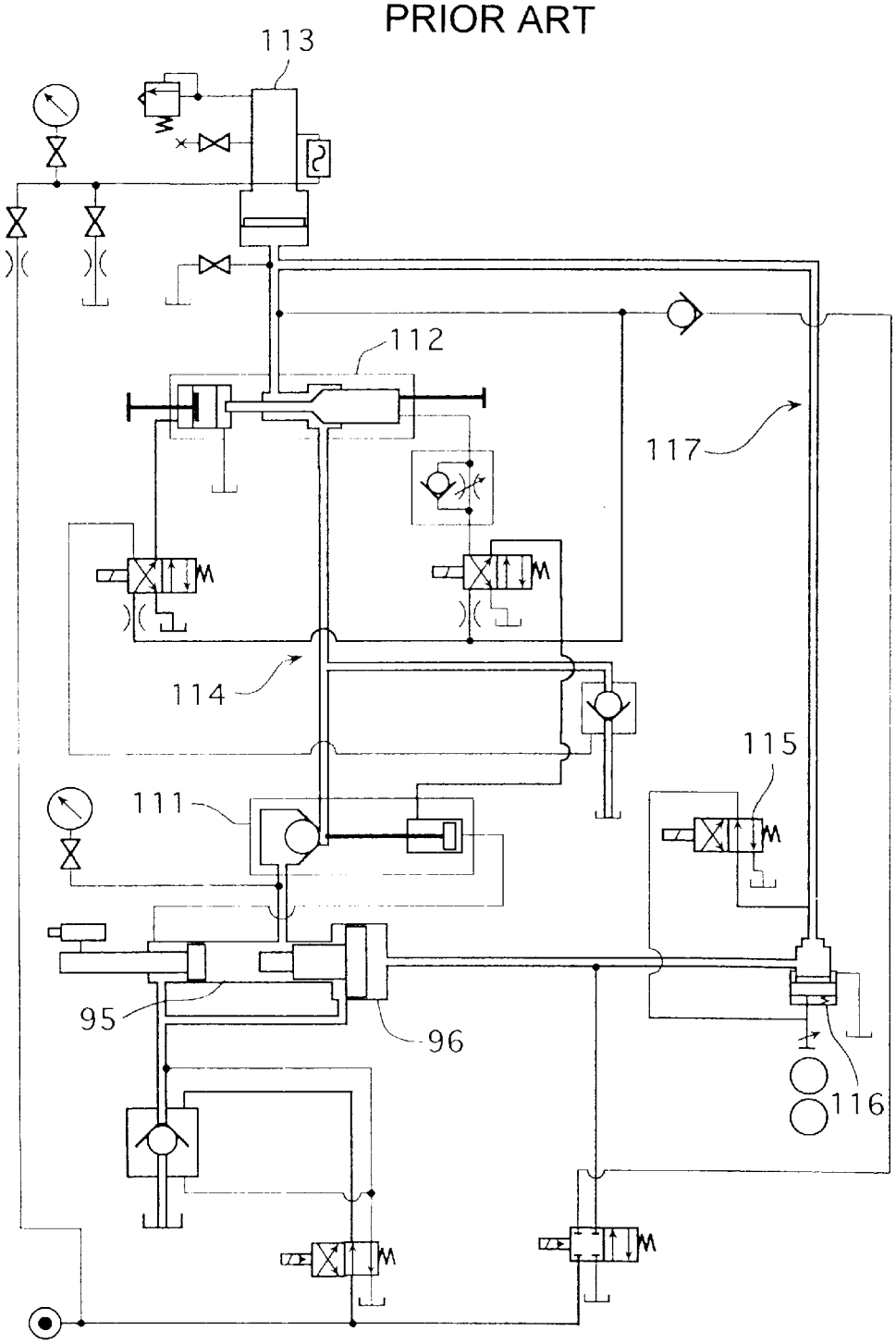
F I G. 9 PRIOR ART
FIG. 9 is a circuit diagram showing an oil hydraulic circuit of the conventional die casting machine.
Figure 10:
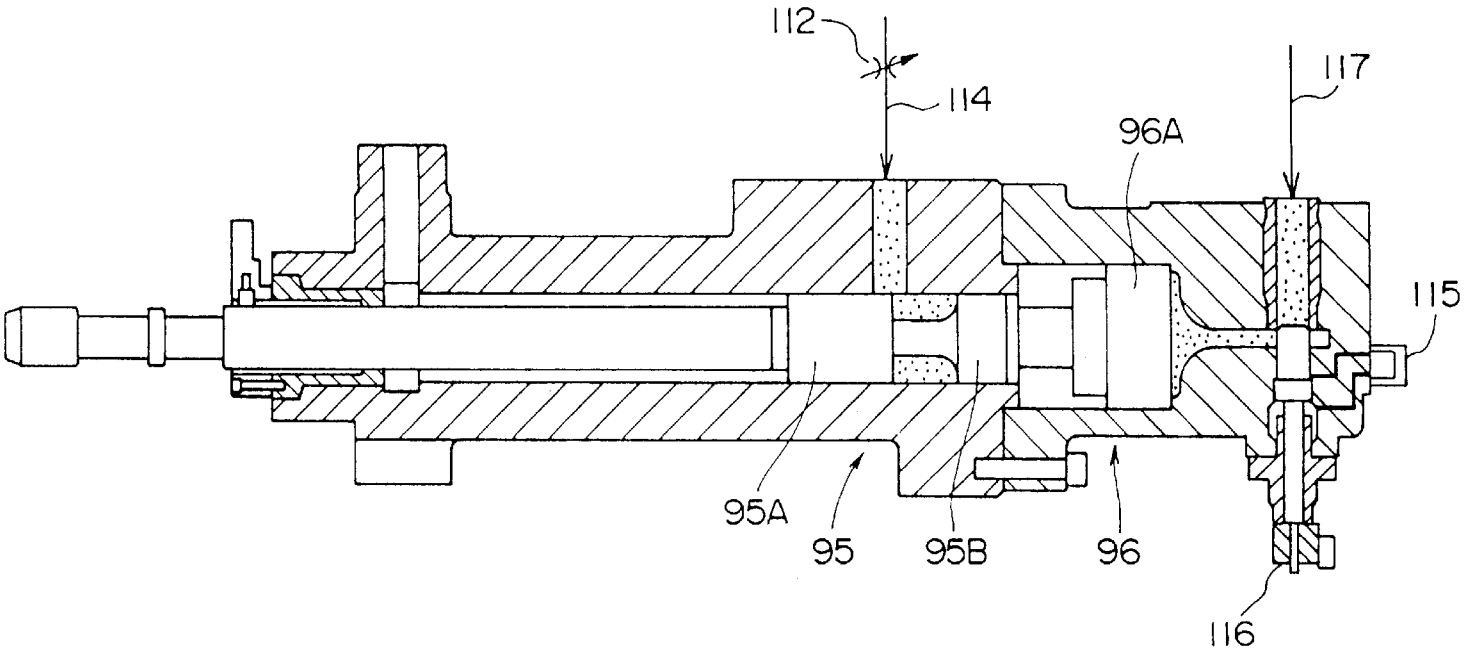
FIG. 10 is a sectional view showing a conventional cylinder device.

The pressurizing curve CP3 results in a similar curve to the aforementioned fin critical curve CX shown in FIG. 8.

Incidentally, the control system 40 achieves the control, in which the opening of the pressurizing controllable valve 21 is throttled and the opening is changed during the process described above, by previously storing an opening target value every predetermined time from the start of the pressurizing process, and carrying out the feedback control for the pressurizing controllable valve 21 while the degree of the opening is changing in sequence to the target opening, required at each predetermined time, with the passage of time commencing from the start of the pressurizing process of the operation.

And further, with a learning function of the control system 40, the opening target value of the pressurizing controllable value 21 can be corrected by using the difference between an estimated injection pressure and the actual injection pressure, sensed by the pressure sensor 36 in the last pressurizing process.

The aforementioned correction caused by the process of controlling target data and the learning function is appropriately achieved by an existing technology of software.

According to the embodiment described thus far, the pressurizing controllable valve 21 and the control system 40 allow the flow of the hydraulic fluid, charged to the pressurizing cylinder device 20, not to be controlled to be switched between ON-OFF but to be controlled to adjustably flow in the pressurizing process, so that fins are previously avoided producing by controlling the pressurizing process in response to the fin critical curve CX, thus producing the high-quality die-casting products.

The pressurizing controllable valve 21 is adapted that the main spool 211 forms the two-way valve with the check-valve function and enables the servo control caused by the position detector 213, therefore, the aforementioned pressurizing process is certainly carried out with a simple structure.

In the injection process, the flow controllable valve 17 for controlling the injection velocity adjustably controls the advancing state of the injection cylinder device 10 by using the back pressure, and further, the pressurization is efficiently carried out by releasing the back pressure control of the injection cylinder device 10 when the process is changed into the pressurizing process, thus effectively producing the high-quality die-casting products.

The fact that the control system 40 easily, certainly and precisely controls the flow of the hydraulic fluid in the pressurizing process every predetermined elapsed time is available for achieving the aforementioned flow-adjustable pressurizing process.

The injection accumulator 13 and the pressurizing accumulator 23 are independent from each other, therefore, the pressures for the injection process and the pressurizing process are independently defined.

And further, the back pressure of the pressurizing accumulator is adjusted by the casting pressure controllable valve 34, thereby allowing the selective adjustment of the maximum pressure in the pressurizing process to be easy and be ensured.

Second Embodiment

Figure 11:
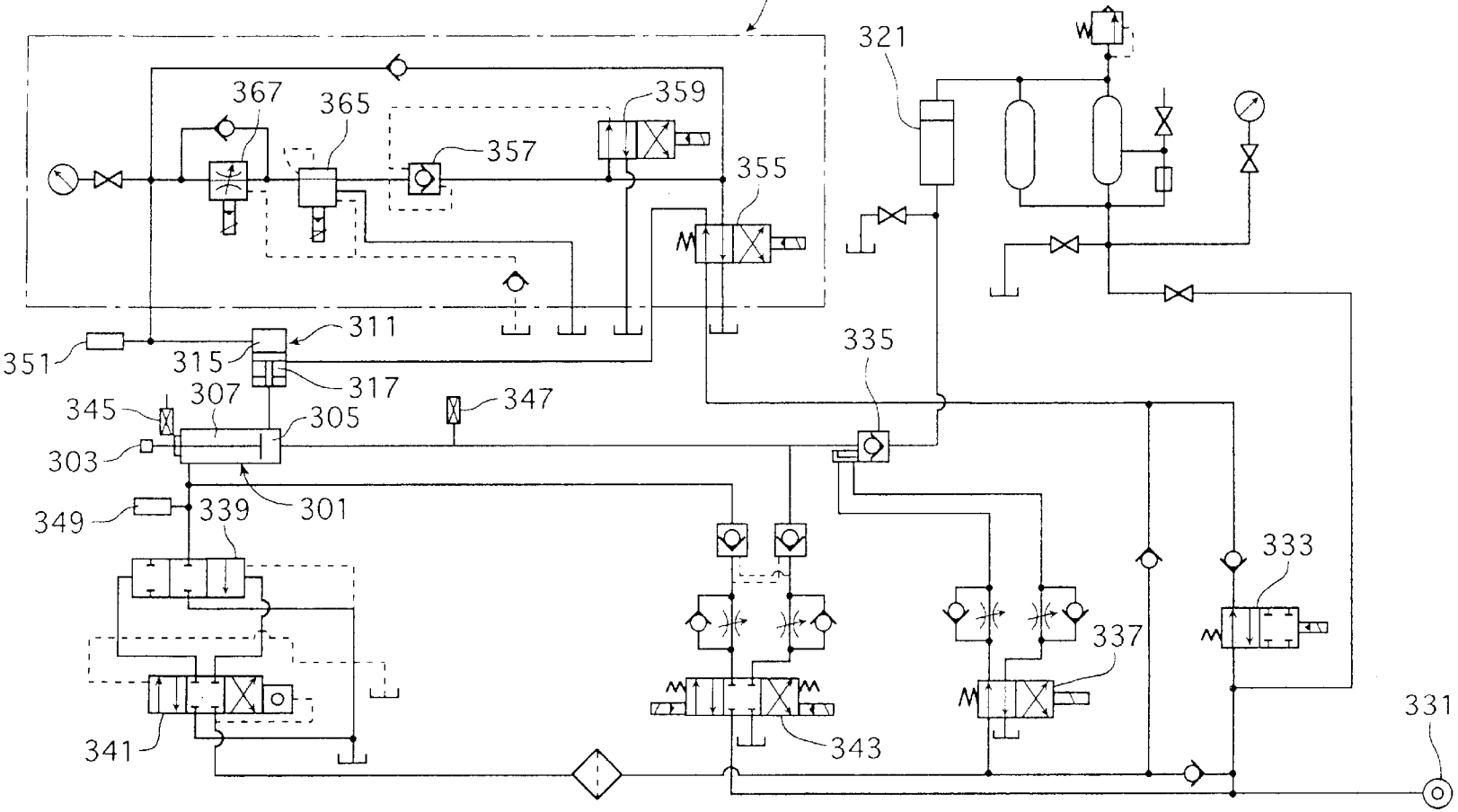
FIG. 11 is a circuit diagram showing the second embodiment according to the present invention.
Figure 12:
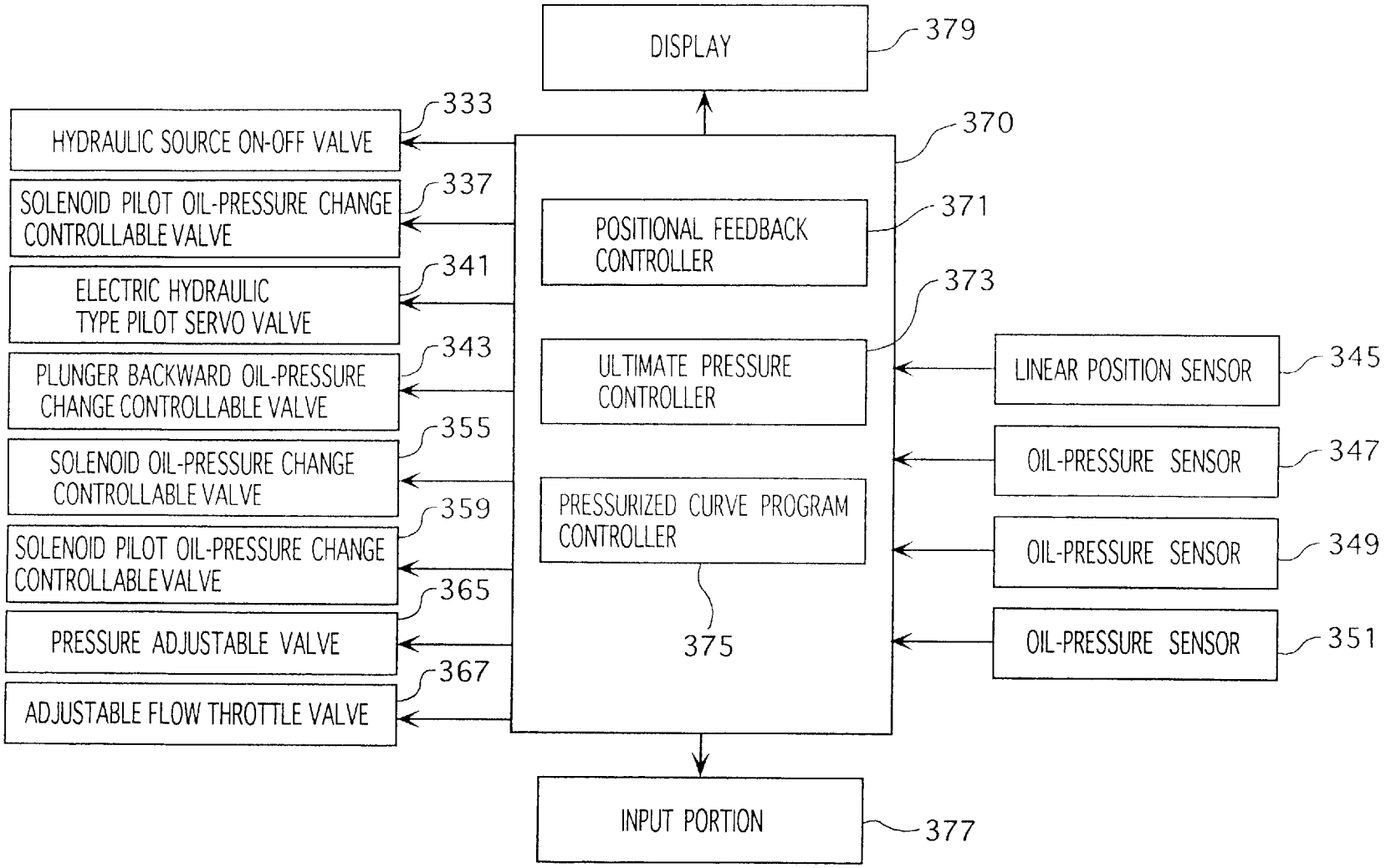
FIG. 12 is a block diagram showing a system of the second embodiment.
Figure 13:
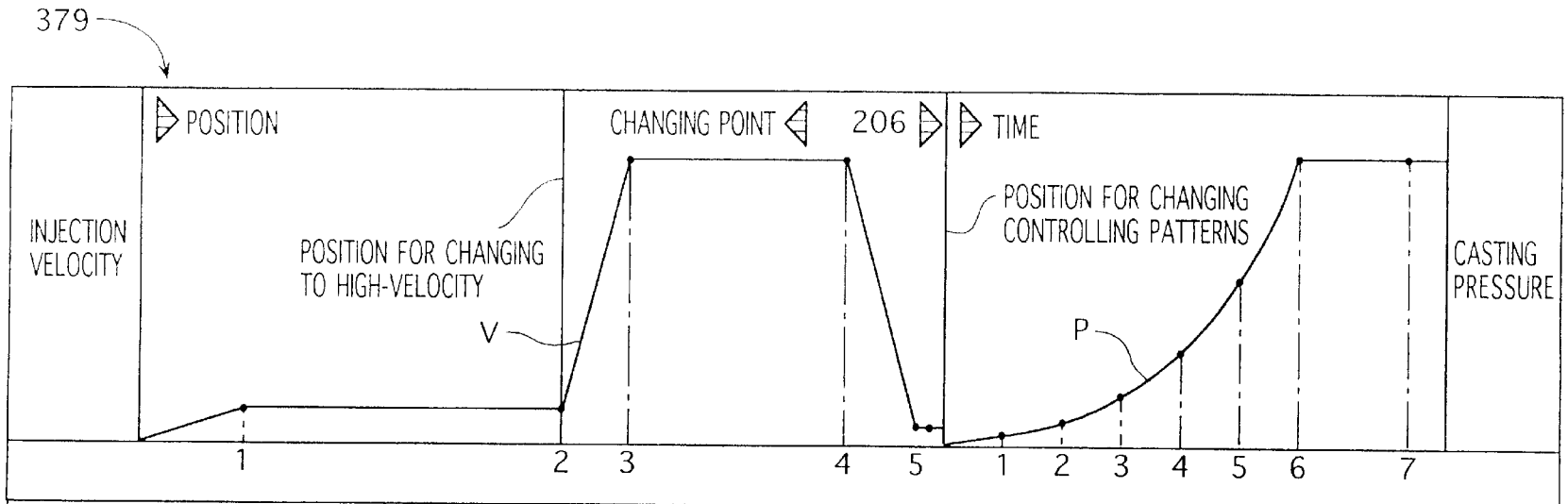
FIG. 13 is a diagram showing a screen for defining input of the second embodiment.

FIG. 11 to FIG. 13 show another embodiment of the injection controlling apparatus of the die casting machine according to the present invention.

In FIG. 11, a feeding cylinder device 301 drives an injection plunger 303, and a increasing-pressure cylinder device 311 pressurizes the oil pressure charged to the forward cylinder room 305 of the feeding cylinder device 301.

The oil hydraulic circuit, controlling to charge and discharge the oil pressure to and from the feeding cylinder device 301 and the increasing-pressure cylinder device 311, has an accumulator 321; a hydraulic source 331; a solenoid hydraulic source on-off valve 333; a check valve with pilot piston 335 for charging the oil pressure of the accumulator 321 to the advancing cylinder room 305 of the feeding cylinder device 301 when the plunger is advanced; a solenoid pilot oil-pressure change controllable valve 337 causing the check valve with pilot piston 335 to selectively and forcibly open; a pilot hydraulic type main servo valve 339 controlling the advancing velocity of the plunger and the position of the plunger by adjustably controlling the flow of the oil flown from a receding cylinder room 307 of the feeding cylinder device 301 when the plunger is advanced; an electric hydraulic type pilot servo valve 341 adjusting the pilot oil pressure of the main servo valve 339; a solenoid plunger backward oil-pressure change controllable valve 343 connecting the receding cylinder room 307 to the hydraulic source 331 to cause the advancing cylinder room 305 to make a drainable connection when the plunger is receded; a linear position sensor 345 sensing the position of the injection plunger 303; an oil-pressure sensor 347 sensing the oil pressure of the advancing cylinder room 305; an oil-pressure sensor 349 sensing the oil pressure of the receding cylinder room 307; an oil-pressure sensor 351 sensing the oil pressure of an advancing cylinder room 315 of the increasing-pressure cylinder device 311; and an increasing-pressure cylinder oil-pressure controlling unit 353.

In turn, the increasing-pressure cylinder oil-pressure controlling unit 353 has a solenoid oil-pressure controllable valve 355 which directs the charge of the pressured oil to the advancing cylinder room 315 and a receding cylinder room 317 of the increasing-pressure cylinder device 311; a check valve with pilot 357 for charging the oil pressure of the accumulator 321 to the advancing cylinder room 315 of the increasing-pressure cylinder device in the pressurization; a solenoid pilot oil-pressure change controllable valve 359 causing the check valve with pilot 357 to selectively and forcibly open; a pressure adjustable valve 365 being composed of a solenoid proportionable valve or an electric servo valve capable of constantly adjusting the oil pressure charged to the advancing cylinder room 315; and an adjustable flow throttle valve 367 being composed of a solenoid proportionable valve or an electric servo valve capable of controlling the flow of the pressured oil, defined by the pressure adjustable valve 365, to the advancing cylinder room 315.

FIG. 12 shows an example of an electric control system for controlling the operation of the aforementioned oil hydraulic circuit.

The electric control system is a process controller 370 composed of a microcomputer including a sequencer, which has a positional feedback controller 371; a ultimate pressure controller 373; a pressurized curve program controller 375; an input portion 377 like a keyboard; and a display 379 like CRT or a liquid crystal display panel.

In turn, the positional feedback controller 371 inputs a measured value of the position of the injection plunger 303 from the linear position sensor 345, and measured values of the oil pressures of the advancing cylinder room 305 and the receding cylinder room 307 from the oil pressure sensors 347 and 349, and further it outputs a pilot oil-pressure instruction signal between the start of the injection and a predetermined position for changing controlling patterns before the stroke end to the electric hydraulic type pilot servo valve 341 so that the positional feedback control for the injection plunger 303 is carried out.

The ultimate pressure controller 373 outputs a pressure instruction to the pressure adjustable valve 365 so that the oil pressure, given to the advancing cylinder room 315 of the increasing-pressure cylinder device 311, corresponds with the ultimate pressure of the casting pressure. The ultimate pressure controller 373 inputs a measured value of the oil pressure of the advancing cylinder room 305 from the oil pressure sensor 347, in which when the measured value is out of an allowable range, the pressure instruction value of the next time is corrected so that the ultimate pressure is within the allowable range. The pressurized curve program controller 375 outputs a flow instruction to the adjustable flow throttle valve 367 so that the flow of the pressured oil flown to the advancing cylinder room 315is adjusted to increase the casting pressure along the fin critical pressurizing curve which does not allow to produce fins, when the injection plunger 303 reaches the predetermined position for changing controlling patterns, in which a pressuring value controlled as a target value is defined at each predetermined interval in the passage of time commencing from the start of the pressurization, for example, every 10 msec, and the amount of the controlled flow of the adjustable flow throttle valve 367 is defined to conform the casting pressure at each of the intervals to the controlling target pressure value at each predetermined interval. The controlling target pressure value can be interactively inputted on the display as shown in FIG. 13.

In P=the casting pressure, a=a coefficient, and t=time, as shown FIG. 13, the amount of the controlled flow of the adjustable flow throttle valve 367 can be defined to pressurize along a quadratic curve created from $P=a(t)^2$.

In an example of FIG. 13, each controlling target pressure value is defined to be 5 kgf/cm$^2$ at a lapse of 10 msec, 20 kgf/cm$^2$ at a lapse of 20 msec, 80 kgf/cm$^2$ at a lapse of 30 msec, 200 kgf/cm$^2$ at a lapse of 40 msec, 350 kgf/cm$^2$ at a lapse of 50 msec, 599 kgf/cm$^2$ at a lapse of 60 msec, and 600 kgf/cm$^2$ at a lapse of 60 msec (the ultimate pressure).

Incidentally, $P=a(t)^2$ is $P=a(t)^n$, but n can be replaced with a coefficient within a range of $0<n<3$.

The amount of the controlled flow of the adjustable flow throttle valve 367 is determined from the difference (the rate of change) of the controlling target pressure values between a point of a lapsed time Tn and the next lapsed time Tn+1.

The pressurized curve program controller 375 inputs a measured value of the oil pressure of the advancing cylinder room 315 of the increasing-pressure cylinder device 311 from the oil pressure sensor 351, in which the amount of the controlled flow of the adjustable flow throttle valve 367 is allowed to undergo feedback compensation so that the casting pressure at each point defined with the controlling target pressures results in the controlling target pressure value with the use of the measured value as a feedback signal.

The following is an explanation as to the operation of the injection controlling device when the plunger is advanced according to the aforementioned structure.

In advancing the plunger, the preparation is the following; in the state the hydraulic source on-off valve 333 is changed over to the opening position, the plunger backward oil-pressure change controllable valve 343 is changed over to the closing position, and the oil-pressure change controllable valve 355 is changed over to the advancing position; the check valve with pilot piston 335 is forcibly opened and closed by the solenoid pilot oil-pressure change controllable valve 337; and the pressured oil of the accumulator 321 is charged to the advancing cylinder room of the feeding cylinder device 301.

Before the position for changing to high-velocity, sensed by the linear position sensor 345 from the position of starting advancing the injection plunger 303, the degree of opening the main servo valve 339 is defined at a position of opening valve at low-velocity (a position of the small-opened valve) by the electric hydraulic type pilot servo valve 341, thereby the injection plunger 303 is advanced at low-velocity to predetermined the position for changing to high-velocity.

The linear position sensor 345 senses that the injection plunger 303 is advanced to the position for changing to high-velocity, whereupon the degree of opening the main servo valve 339 is defined at a position of opening valve at high-velocity (a position of the large-opened valve) by the electric hydraulic type pilot servo valve 341, thereby the injection plunger 303 is advanced at high-velocity to the position for changing controlling patterns. Thus feeding the molten material into the die cavity at high-speeds.

Therefore, during the advancement of the injection plunger 303 from the position of starting advancing to the position for changing controlling patterns, the relationship between the position and the velocity of the injection plunger 303 is promoted as illustrated with a sign V in FIG. 13.

As described thus far, during the advancement of the injection plunger 303 from the position of starting advancing to the position for changing controlling patterns, the controlling properties are defined with the relationship between the position and the velocity of the injection plunger 303, and further, can be interactively inputted on the display shown in FIG. 13.

The linear position sensor 345 senses that the injection plunger 303 is advanced to the position for changing controlling patterns, whereupon the check valve with pilot 357 is forcibly opened and closed by the solenoid pilot oil-pressure change controllable valve 359, the pressured oil of the accumulator 321 is charged to the advancing cylinder room 315 of the increasing-pressure cylinder device 311, and then the pressurization for the injection plunger 303 is started.

At this time, the pressured oil charged to the advancing cylinder room 315 of the increasing-pressure cylinder device 311 is defined to correspond with the ultimate pressure of the casting pressure by the pressure adjustable valve 365, and further, is program-controlled by the adjustable flow throttle valve 367. Therefore, the casting pressure is increased along the fin critical pressurizing curve which does not allow to produce fins, thus avoiding fins.

Modification or the Like

Incidentally, it is to be understood that the present invention is not intended to be limited to the above-described embodiments, and the following modification or the like may be made therein without departing from the spirit of the present invention. Such changes are also included in the scope of the present invention.

More specifically, the injection accumulator 13 and the pressurizing accumulator 23 are separately provided, but may be commonly used.

The accumulator charge change-over valve 32, the pressure sensors 35 and 36, the encoder 152 and so on can be appropriately substituted with another structures or may be omitted if necessary.

And further, configuration, size, material and so on of each component, such as the pressurizing controllable valve 21, the flow controllable valve 17 for controlling injection velocity, and so on, may be appropriately selected in performances.

What is claimed is:

1. A method for controlling injection in a pressurizing-type die casting machine having an injection plunger for injecting molten material into a casting die, an injection cylinder device for driving the injection plunger, and a pressurizing cylinder device for pressurizing a hydraulic fluid to the injection cylinder device, the method comprising the steps of:

controlling an injection velocity of the molten material into the casting die by controlling a hydraulic fluid flow to the pressurizing cylinder device during a first pressurization process; and controlling a casting pressure and a pressurizing period by controlling the flow of the hydraulic fluid to the pressurizing cylinder device during a second pressurization process, the casting pressure and the pressuring period being determined by a selective curve along a predetermined critical curve for preventing the casting die from producing fins.

2. The method for controlling injection in the die casting machine according to claim 1, further comprising the step of, before controlling the hydraulic fluid flow to the pressurizing cylinder device, controlling pressurization of the hydraulic fluid flown to the pressurizing cylinder device, to correspond with an ultimate casting pressure of the casting die.

3. The method for controlling injection in the die casting machine according to claim 1, further comprising the steps of:

controlling charge and discharge of the hydraulic fluid to and from the injection cylinder device, the controlling step being performed from a starting position of the injection plunger to a predetermined position before a stroke end position of the injection plunger so that a positional feedback control of the injection plunger is carried out; and controlling the casting pressure and the pressurizing period based on the selective curve along the predetermined critical curve for preventing the casting die from producing fins, after the injection plunger reaches the predetermined position.

4. The method for controlling injection in the die casting machine according to claim 1, wherein the control of the hydraulic fluid flow to the pressurizing cylinder device causes the casting pressure to increase to the $n^{th}$ degree in the following equation; $P=a(t)^n$, where P is the casting pressure, a is a coefficient, t is pressurization time and n is a coefficient within the range of $0<n<3$.

5. The method for controlling injection in the die casting machine according to claim 1, further comprising the steps of: using a flow controlling valve having a check-valve function and a main spool for controlling the hydraulic fluid flow to the pressurizing cylinder device, a position detector for detecting a degree of opening of the main spool of the flow controlling valve, and a pressurizing controlling device for controlling the main spool of the flow controlling valve based on a predetermined program; and controlling a selective degree of opening of the main spool between a full opening and a final opening during the second pressurization process by the pressurizing cylinder device.

6. A method for controlling injection in the pressurizing-type die casting machine having an injection plunger for injecting molten material into a casting die, an injection cylinder device for driving the injection plunger, and a pressurizing cylinder device for pressurizing a hydraulic fluid to the injection cylinder device, the method comprising the steps of:

using a flow controlling valve having a check-valve function and a main spool for controlling a hydraulic fluid flow to the pressurizing cylinder device, a position detector for detecting a degree of opening of the main spool of the flow controlling valve, and a pressurizing controlling device for controlling the main spool of the flow controlling valve based on a predetermined program;

controlling an injection velocity of the molten material into the casting die by controlling a hydraulic fluid flow to the pressurizing cylinder device during a first pressurization process; and controlling a selective degree of opening of the main spool between a full opening and a final opening during a second pressurization process by the pressurizing cylinder device and controlling the second pressurization process by changing the relationship between a casting pressure and a pressurizing period based on a selective curve along a predetermined critical curve for preventing the die casting from producing fins.

7. The method for controlling injection in the die casting machine according to claim 6, further comprising the steps of:

starting injection process to advance the injection plunger by using the injection cylinder device;

controlling charge and discharge of the hydraulic fluid to and from the injection cylinder device so that velocity and advancing position of the injection plunger are feedback-controlled;

decelerating the injection cylinder device when the injection cylinder device reaches a decelerating-start position at a predetermined distance before a stroke end position;

subsequently starting the second pressurization process by the pressurizing cylinder device when the injection cylinder device reaches a predetermined pressurizing-start position located near the stroke end position; and performing second pressurization process control by controlling the opening of the main spool.

8. The method for controlling injection in the die casting machine according to claim 6, further comprising the steps of:

starting injection process to advance the injection plunger by using the injection cylinder device;

controlling a back pressure of the injection cylinder device with a back pressure control valve using a fast-response electric-hydraulic servo two-way valve, located on a hydraulic fluid discharge channel of the injection cylinder device so that an advancing position and velocity of the injection plunger are feedback-controlled;

decelerating the injection cylinder device when the injection cylinder device reaches a decelerating-start position located at a predetermined distance before a stroke end position;

releasing the back pressure of the injection cylinder device by fully opening the back pressure controllable valve when the injection cylinder device reaches a back pressure release position placed in the vicinity of the stroke end rather than the decelerating-start position; subsequently starting the second pressurization process by the pressurizing cylinder device when the injection cylinder device reaches a pressurizing-start position adjacent to the back pressure release position; and performing the second pressurization process by controlling the opening of the main spool.

9. An injection controlling apparatus of a pressurizing-type die casting machine having an injection plunger for injecting molten material into a casting die, an injection cylinder device for driving the injection plunger, and a pressurizing cylinder device for pressurizing a hydraulic fluid to the injection cylinder device, the injection controlling apparatus comprising:

an injection controlling means for controlling charge and discharge of the hydraulic fluid to and from the injection cylinder device and performing a positional feedback control of the injection plunger;

a flow controlling means for controlling a hydraulic fluid flow to and from the pressurizing cylinder device during first and second pressurization processes; and a second pressurization process controlling means for controlling the second pressurization process by changing the relationship between a casting pressure and a pressurizing period based on a selective curve along a predetermined critical curve for preventing the casting die from producing fins by controlling the flow controlling means during the second pressurization process by the pressurizing cylinder device.

10. The injection controlling apparatus of the die casting machine according to claim 9, further comprising a casting pressure adjustment means for controlling the hydraulic fluid pressure to the pressurizing cylinder device, to correspond with an ultimate casting pressure.

11. The injection controlling apparatus of the die casting machine according to claim 9, wherein the pressurizing controlling means controls the second pressurization process by controlling the flow controlling means based on a predetermined program.

12. The injection controlling apparatus of the die casting machine according to claim 9, wherein the second pressurization process controlling means controls the flow controlling means so that the casting pressure is within a controlling pressure target value defined at each predetermined interval from the start of the second pressurization process.

13. The injection controlling apparatus of the die casting machine according to claim 9, wherein the injection controlling means controls back pressure of hydraulic fluid discharging side of the injection cylinder device and carries out a positional feedback control of the injection plunger.

14. The injection controlling apparatus of the die casting machine according to claim 9, wherein the flow controlling means has a flow controlling valve having a check-valve function and a main spool controlling the hydraulic fluid flow to the pressurizing cylinder device, and a position detector for detecting a degree of opening of the main spool of the flow controlling valve; and the pressurizing controlling means controls the degree of opening of the main spool to be between a full opening and a final opening during the second pressurization process by the pressurizing cylinder device in order to control the boost pressurization to change the relationship between the casting pressure and the pressurizing period based on the selective curve along the predetermined critical curve for preventing the casting die from producing the fins.

15. An injection controlling apparatus of a pressurizing-type die casting machine having an injection plunger for injecting molten material into a casting die, an injection cylinder device for driving the injection plunger, and a pressurizing cylinder device for pressurizing a hydraulic fluid to the injection cylinder device, the injection controlling apparatus comprising:

an injection controlling means for controlling charge and discharge of the hydraulic fluid to and from the injection cylinder device and performing a positional feedback control of the injection plunger;

a casting pressure adjustment means for controlling the hydraulic fluid pressure to the pressurizing cylinder device, to correspond with an ultimate casting pressure, the casting pressure adjustment means being flow-connected to the pressurizing cylinder device;

a flow controlling valve having a check-valve function and a main spool controlling hydraulic fluid flow to the pressurizing cylinder device, the hydraulic fluid flow being controlled by the casting pressure adjustment means;

a position detector for detecting a degree of opening of the main spool of the flow controlling valve; and a pressurizing controlling means controls the degree of opening of the main spool to be between a full opening and a final opening during a second pressurization process by the pressurizing cylinder device in order to control the second pressurization process to change the relationship between a casting pressure and a pressurizing period based on a selective curve along a predetermined critical curve for preventing the casting die from producing fins.

16. The injection controlling apparatus in the die casting machine according to claim 15, wherein the pressurizing controlling means controls the degree of opening of the main spool so that the casting pressure is within a controlling pressure target value defined at each predetermined interval from the start of the second pressurization process.

* * * * *